United States Patent [19]

Breidenbaugh

[11] Patent Number: 4,541,927

[45] Date of Patent: Sep. 17, 1985

[54] ENVIRONMENTAL PROTECTION DREDGING SYSTEM FOR SEPARATING SOLIDS AND LIQUID

[76] Inventor: Paul M. Breidenbaugh, 26 N. Montford Ave., Baltimore, Md. 21224

[21] Appl. No.: 676,107

[22] Filed: Nov. 29, 1984

[51] Int. Cl.[4] ..... B01D 33/00; E02F 3/88

[52] U.S. Cl. ..... 210/122; 37/58; 37/61; 210/170; 210/512.2

[58] Field of Search ..... 37/54, 58, 61–63, 37/59, 195, 57; 299/7–9; 56/8, 9; 210/170, 512.2, 122

[56] References Cited

U.S. PATENT DOCUMENTS

| | | | |
|---|---|---|---|
| 1,864,926 | 6/1932 | Moss et al. | 299/9 |
| 2,204,584 | 6/1940 | Flower | 299/9 X |
| 3,546,858 | 12/1970 | Chaplin | 56/9 |
| 3,884,018 | 5/1975 | Chaplin | 56/9 |
| 3,975,842 | 8/1976 | Andreae | 37/58 |

FOREIGN PATENT DOCUMENTS

| | | | |
|---|---|---|---|
| 796327 | 1/1981 | U.S.S.R. | 37/58 |

*Primary Examiner*—Clifford D. Crowder

[57] ABSTRACT

An environmental protection floating dredging system for removing material from the bottoms of bodies of water, separating it into liquid and semi-solid and solid components by the action of co-acting on-board centrifugal separators and dryers of the solid material dredged and a suction return system for collecting and recirculating the liquid component through the dredging system by way of the dredge head, thus minimizing disturbance of the bottom dredged and pollution by material discharged overboard, and eliminating pollution from dumping of separated solids, which are processed and stored aboard in light-weight dry form adapted for dry-landfill and for use in aggregate mixes in some cases.

16 Claims, 2 Drawing Figures

ENVIRONMENTAL PROTECTION DREDGING SYSTEM FOR SEPARATING SOLIDS AND LIQUID

This invention relates generally to dredging and particularly to floating hydraulic dredging means and method.

In the prior art various dredging systems have been disclosed for subaqueous removal of materials to locations remote from the sites dredged, including systems having provisions for separating spoil into constituent components, as represented by U.S. Pat. Nos. 3,673,716 issued July 4, 1972, to Alois Trondle; 2,961,782 issued Nov. 29, 1960, to W. A. Bois; 2,204,584 issued June 18, 1940, to H. B. Flower; and 1,864,926 issued June 28, 1932, to S. A. Moss et al.

However, to date the objects of the present invention have not been provided in the prior art.

A principal object of the present invention is to provide a unitary or self-contained, dredging system which accomplishes the removal of hydraulically dredgeable subaqueous material with minimal environmental disturbance resulting from the spoil agitation inherent in the ordinary methods of such dredging. Particularly includable in this category are operations over deep silt and other mud bottoms where tidal or other currents tend to disperse material disturbed and redeposit it away from the site dredged. Other objects are to provide a dredging system which eliminates dikes and sluices and pollution from them, and need for the resident inspectors often employed, and provides minimum-weight solid spoil.

Still other objects are to provide a system as described which reclaims the spoil in a novel efficient manner, separating, drying and packing it on board in form ready for further use.

Further objects are to provide a system as described which is adaptable for installation as a unit on many barges and partially decked scows with little modification except for simple local reinforcement and attachment.

And further important objects are to provide for noninterruptive or continuous dredging in combination with a continual batch process for immediately separating the components of the material hydraulically dredged while in semi-fluid, non-settled condition, the batches being of sufficient number to accommodate the volume dredged and sufficiently small to permit relatively high-speed certrifuging promoting efficient clarification of liquid and drying of separated solids.

The above and other objects and advantages of the invention will become more readily apparent on inspection of the following description, including the drawings in which like numerals indicate like parts:

FIGS. 1 and 2 show the general relation of the subsystems and operation of the overall dredging system of this invention in embodiment 10 as described.

BRIEF DESCRIPTION: MAJOR SUB-SYSTEMS AND OPERATION

Figure 1:
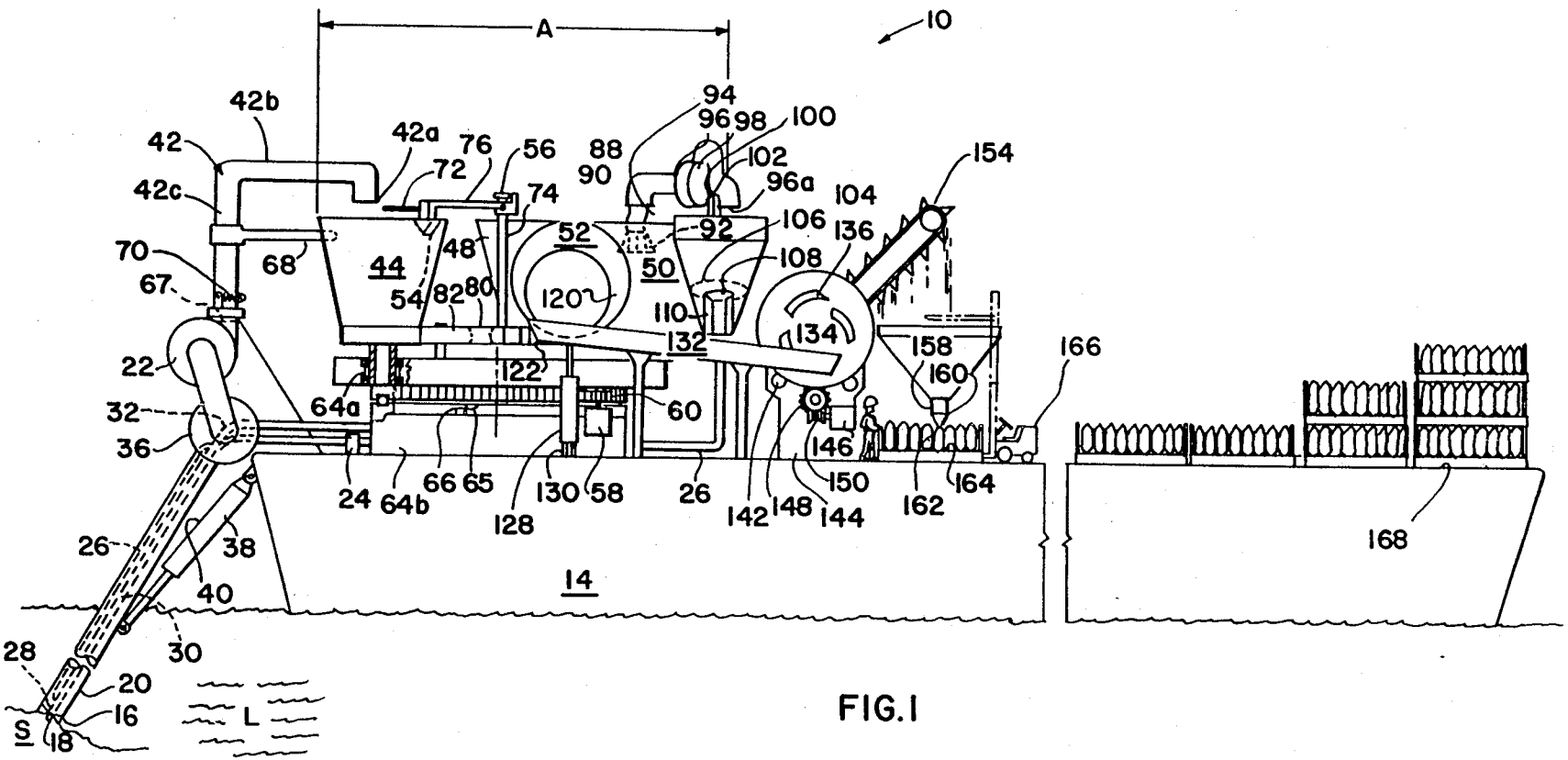
FIG. 1 is a side elevation of the invention in use.

In brief overall description, the invention includes eight major sub-systems, listed here in general sequence of operation.

I. Intake Sub-systems: includes the cutter head, intake tube, pump and centrifugal separator filling-tube; functions to lift subaqueous spoil continuously and load it into the centrifuge containers.

II. Centrifugal Separation Sub-system: includes the centrifuge containers and bearings on which they spin, the centrifuge drive and centrifuge container dump apparatus functions to dissociate the liquid and solid portions of the spoil and to discharge the batches of solid material.

III. Rotary Table Sub-system: includes the rotary ring-shaped base which carries the centrifuge containers; functions to position the centrifugal containers successively in the positions for loading, spinning, skimming by the Liquid Removal Sub-system (described next), and braking and dumping.

IV. Liquid Removal and Recirculation Sub-system: includes liquid suction head, pump, funnel, screen, fluid line to cutter head, and solid filtrate discharge port; functions to return centrifuge-clarified liquid for recirculation through the cutter head and to screen out and selectively discharge into the Drying Sub-system (to be described next) light solids entrained in the centrifuge dissociated liquid.

V. Drying Sub-system: includes feeder chutes, tumbler cylinder and oven cylinder for passing separated solids; functions to dry the separated solids passed through the cylinders.

VI. Packaging Sub-system: includes elevator intake hopper, elevator, elevator exhaust hopper, bagging tube, valve, and bag apparatus; functions to bag the dried spoil.

VII. Distribution Sub-system: includes fork lifts and pallets; functions to distribute and store palletized bagged spoil ready for offloading.

VIII. Float Sub-system: includes the barge or other vessel supporting and positioning the Dredging System generally.

Synchronization structure is included in the various sub-systems and is described in conjunction with the detailed description of the sub-systems.

DETAILED DESCRIPTION OF THE STRUCTURE OF THE INVENTION

Vessel 14 carries the system; it preferably is a simple flat-deck barge onto which the components are lifted and secured, leaving a large flat area at the stern for storage.

Cutter head 16 comprises a conventional plural rotary blade device having apertures 18 between the blades for passing spoil S dislodged by the blades upward into the suction tube 20. Initially, ambient liquid L such as river or seawater is pulled into the suction tube by lift pump 22 mounted above the cutter head. The spoil removal operation of the System is continuous, and after equilibrium is reached clarified liquid recirculates through the cutter head in a continual lifting stream, injected by pressure pump 24 into the suction tube through recirculation line 26 attached to the suction tube through nozzles 28.

Result of this continual injection of clarified fluid is to reduce turbulence at the dredge head and liquid discharge, and help lift and scour the solid material by induction, greatly reducing the quantity of muddy water normally returned to the body of water. The additional lifting of solid material increases the overall efficiency of the system.

The cutter head is operated by a driveshaft 30 from a motor aboard the vessel, in conventional manner. The drive shaft may be flexible locally or may have a universal joint 32 to permit angular redeployment of the suction tube as required during dredging. The recirculation line is flexible in part as at 34 to permit the suction tube redeployment and a conventional ball tube joint 36 fixed to the vessel provides the necessary articulation in the suction tube. Hydraulic piston assemblies 38, 40 respectively attached between the sides of the suction tube and to the vessel, controlled by conventional means, redeploy the suction tube as required.

The lift pump, which may be a centrifugal pump as shown, discharges on the pressure side through distributor conduit or tube 42 which turns down at the exhaust end **42*a* and delivers the lifted spoil downward in turn into the respective centrifuge containers 44, 46, 48, 50, 52.**

As each container in turn is filled, float 54 on rising trips synchronizing switch 56 actuating drivemotor 58 and through pinion 60 and ring gear 62 mounted around ring-shaped rotary table **64*a*, 64*b* (top and base respectively, the base being in FIG. 1) rotating the rotary table (large arrow) through the angular increment necessary to shift the filled container clockwise to the next station and position an empty container in place of the filled container. Appropriately spaced lugs 65 attached to the ring gear strike fixed switch 66 to stop the rotary table. The float has a boat-shaped lower portion with ends radiused so that it rides up and over each container edge moving past it, transferring smoothly from container to container. As noted, spoil is continuously dredged up by the system and ejected through the distributor tube; to prevent spillage as the containers shift, the distributor tube horizontal portion 42*b* oscillates about the vertical portion 42*c* on a bearing 67 swinging with the maintaining position over the filled container in response to thrust of the filled container against arm 68 fixed to the distributor tube and extending into the sweep "A" of travel of the centrifuge containers when shifted by the rotary table. The return half of discharge tube oscillation commences when the arm slips off the filled container, releasing the discharge tube for restoration to the initial position by spring 70** attached between the lateral portion of the discharge tube and any convenient fixed structure such as the pump, shown.

Spillage is prevented on the return half cycle of distributor tube oscillation by shunt 72, a chute mounted under a portion of the arc of swing of the discharge end of the distributor tube. The shunt is just long enough to bridge over the space between proximate centrifuge containers and is inclined downward in the direction of turntable rotation. The arm is offset from the distributor tube a distance such that the discharged material does not reach the shunt upper end until a container is in position to receive it.

Pedestal 74, fixed upright to the barge deck within the ring-shaped rotary table, supports the shunt in position, and rotatively mounts about a horizontal axis pivot arm 76 which holds the previously mentioned float in a direction generally radial to the perimeter arc of travel A of the centrifuge containers.

As result of rotary table rotation each filled centrifuge container is in turn rotationally accelerated (small arrow) and maintained in spin by contact between it and the centrifuge drive which comprises a drivemotor 78, belt or chain transmission member 80 and rotary members 82, 84, 86 positioned to drive three centrifuge containers at a time.

While spinning at the maximum rate in the spinning centrifuge container most advanced around the rotary table the liquid component of the spoil is skimmed from the top center of the solids by suction head 88. The suction head has a thin, broad, floating lower portion 90 surmounted by a perforated intake portion 92 vertically connected through a flexible tube 94 with a transverse structural pipe 96 having a suction pump 98 intermediate the length, and having a pivotal connection 100 near the discharge end **96*a* to a pedestal 102 rising from the deck; the pedestal also supports funnel 104** beneath the discharge end of the transverse pipe. The flexible tube permits the assembly to position automatically in the containers beneath it.

Centrifuge-clarified fluid discharges downward into the funnel then downward through inclined screen 106 fixed low within the funnel, into the liquid recirculation line, then through the pressure pump and into the cutter head as previously described.

Screened-out solids such as lighter components entrained in the centrifuge-separated liquid are caught by the inclined screen. Door 108 in the wall of the funnel, when opened releases this material to flow down funnel chute 110 for collection below and processing with the solid material remaining in the centrifugal container from which the liquid has been removed.

Figure 2:
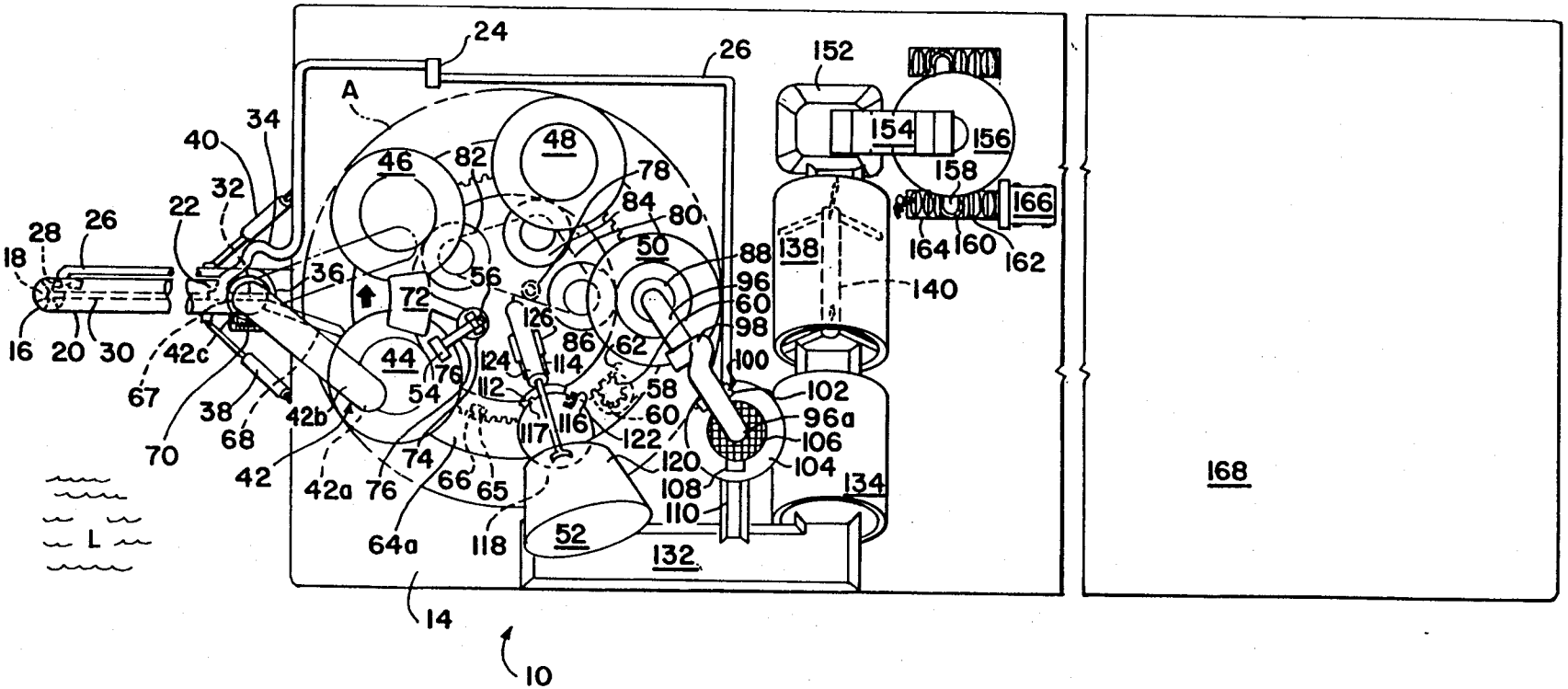
FIG. 2 is a plan view of the FIG. 1 apparatus.

At the next station following liquid removal the centrifuge containers are in turn braked to a stop by a brakeshoe 112 advanced under manual control by a hydraulic piston assembly 114 against the lower or bearing mounting portion 122 of the centrifuge apparatus, which has the shape and function of a brakedrum. A slightly raised spring loaded detent 116 on each brakedrum portion causes the centrifuge container to stop spinning at the same rotational point or orientation each time by engaging a recess 117 in brakeshoe 112 (FIG. 2).

At this orientation, hinge 118 connecting the upper portion 120 of the centrifuge container assembly with the lower portion 122 is outboard. (The hinge and part of the structure described in the next sentence appear only in FIG. 2.)

Solid material in the centrifuge container is dumped by tipping the upper portion under manual control. Co-acting fork-end hydraulic piston assemblies 124 pointing radially outward and upward from mount 126 inside the rotary table, and 128 (FIG. 1 only) pointing radially inward and upward from mount 130 outside the rotary table, are actuated in opposition, the inner one operated to prevail in dumping and the outer one operated to prevail in restoring the centrifuge container to the upright position.

Solid material dumped flows down inclined chute 132 into inclined cylindrical tumbler 134 which aerates the mass with the aid of blades 136 (FIG. 1) and passes it down to inclined cylindrical rotating oven 138 (FIG. 2) which has appropriate strut-supported conventional gas-fired or electric heating means 140 in it. The relative dryness of the material entering and the gravity flow and plural stage agitation prevent clogging, spread the material, and promote quick and thorough drying of the pulverized material.

Conventional bearings 142 (FIG. 1) in forked mounts 144, drivemotors 146, and gearing 148, 150 support and rotate both cylindrical units.

Dried pulverized solid material spills from the oven into elevator intake hopper 152 (FIG. 2) from which elevator 154 removes it and dumps it into elevator exhaust hopper 156 which is equipped with conventional bagging tubes 158 (FIG. 1) and manual valves 160. If the bottom dredged consists largely of sand or gravel, the system produces washed, dried material ready for use in aggregate mixes and the like.

The dried solid material is bagged in individual lots in sacks 162 held on pallets 164. This operation like other operations in the system can be manually or synchronously controlled. Then by fork-lift 166 the bagged material is transported to deck storage areas 168 from which it is conveniently transferrable in the same roll-away manner to motor trucks or railroad cars at dock-side. Need for specialized storage equipment and off-loading equipment is thus eliminated.

It is important to note that in actual numbers, the transport weight saved in the solid material by this invention exceeds fifty pounds per cubic foot, and this represents in like manner nearly fifty pounds of clarified water returned for each cubic foot of material removed.

Obviously many modifications and variations of the present invention are possible in light of the above teachings. It is therefore to be understood that within the scope of the appended claims the invention may be practiced otherwise than as specifically described. One example is the sludge from waste treatment plants.

What is claimed and desired to be secured by U.S. Letters Patent is:

1. A unitary dredging system comprising a vessel having thereon: means for continuously lifting spoil, comprising a hydraulic dredge head; a distributor conduit having connection with the hydraulic dredge head, a turntable on the vessel, means for continually centrifugally-separating the spoil lifted into liquid and solid components, comprising a plurality of containers with means rotatably mounting each container about a vertical axis, all said vertical axes equally spaced around the circumference of the turntable, means for incrementally turning the turntable for positioning each container in turn beneath the distributor conduit, means for successively rotating the containers about said respective axes; means for additionally lifting spoil with said liquid component, comprising means for injecting said separated liquid component upwardly within the hydraulic dredge head; means for drying said solid component, means for bagging in individual lots said component dried, and means for moving and storing aboard the vessel the individual lots bagged.

2. A unitary dredging system as recited in claim 1, said distributor conduit having respective intake and output ends, the distributor conduit connection with the hydraulic dredge head including means pivotally mounting the intake end of the distributor conduit thereto, means for maintaining the position of the output end of the distributor conduit successively over the containers as the turntable turns, and means for preventing the continuously lifted spoil from discharging between containers moved past the distributor conduit on rotation of the turntable.

3. A unitary dredging system as recited in claim 2, wherein the means for maintaining the output portion of the distributor conduit successively over the containers comprises an arm connected therewith and extending toward the turntable in position for contacting the respective containers on turning of the turntable, thereby oscillating the distributor conduit about said pivotal mounting.

4. A unitary dredging system as recited in claim 3, wherein the means for preventing the continuously lifted spoil from discharging between containers comprises a chute positioned for bridging the space between proximate containers beneath a portion of the arc of oscillation of the distributor tube.

5. A unitary dredging system as recited in claim 4, the means for incrementally turning the turntable including; a float, a horizontal pivot mounting the float in position to lower into each container in turn proximately beneath the distributor tube, contoured ends on the float aligned for contacting sides of said containers during turning of the turntable a switch responsive to the vertical position of the float, and a motor drive having operative connection with the turntable and responsive connection with the switch.

6. A unitary dredging system as recited in claim 4, wherein the turntable is ring-shaped, wherein the means for successively rotating the containers is located centrally of the turntable and protrudes towards the circumference thereof a distance causing operative contact with successive containers as the turntable rotates.

7. A unitary dredging system as recited in claim 6, wherein the protrusion of the means for successively rotating the containers causes operative contact with plural of said containers simultaneously.

8. A unitary dredging system as recited in claim 7, wherein the means for continually separating spoil includes: a suction system having a floating suction head, a pump means for connecting the suction head and the pump including a flexible tube suspending the suction head in position for descending successively into the respective containers as the turntable turns and removing the centrifugally separated liquid component therefrom, a funnel in position for receiving the liquid from said pump, an inclined screen in the funnel, a first chute for conveying the solid component screened out away from said funnel, and a line and pressure pump for conveying the liquid component screened out to said dredge head and thereby comprising the means for injecting said separated liquid component.

9. A unitary dredging system as recited in claim 8, each said container having an upper portion for containing material, a lower portion, and means hinging together the upper and lower portions.

10. A unitary dredging system as recited in claim 9, means for successively braking said container rotation including means for stopping said rotation with said container hinging means at a predetermined orientation, means for successively tipping and dumping each said upper portion, when stopped, with the hinging means at said predetermined orientation; means for restoring each tipped container upper portion to vertical position, and means including a second chute for successively receiving and conveying the solid component from each container to said means for drying.

11. A unitary dredging system as recited in claim 10, the means for drying including a cylindrical tumbler and a cylindrical oven, the first chute inclined for emptying into the second chute, the second chute inclined for emptying into the cylindrical tumbler, and the cylindrical tumbler inclined for emptying into the cylindrical oven.

12. A unitary dredging system as recited in claim 11, the means for bagging in individual lots said component dried comprising: an elevator intake hopper positioned for receiving said dried component, an elevator positioned for lifting said dried component from the elevator intake hopper, an elevator exhaust hopper positioned for receiving dried material lifted, and at least one valve on the elevator exhaust hopper for dispensing into bags the dried material received therein.

13. A unitary dredging system as recited in claim 12, a plurality of pallets for holding bags containing said dried material, a lift truck for moving said pallets, and a flat deck area on the vessel adjacent the elevator exhaust hopper for receiving and storing pallets moved thereover by the lift truck.

14. A unitary dredging system as recited in claim 10, wherein the means for braking and stopping the container rotation includes a brakeshoe, and an actuator positioned for urging the brakeshoe against a container lower portion.

15. A unitary dredging system as recited in claim 14, wherein each container lower portion has a resilient protrusion thereon, and wherein the brakeshoe has a recess therein for receiving said resilient protrusion.

16. A unitary dredging system as recited in claim 10, wherein the means for successively tipping and dumping and the means for restoring comprise a pair of coacting extensible assemblies, the first said assembly located within the ring-shape of the turntable and oriented to extend against a container upper portion in a radially outward and upward direction, thereby tipping the container, and the second said assembly located without the ring shape of the turntable and oriented to extend against said container upper portion in a radially inward and upward direction, thereby restoring the container upper portion to an upright position.

* * * * *